US006450554B1

(12) United States Patent
Rotondi et al.

(10) Patent No.: US 6,450,554 B1
(45) Date of Patent: Sep. 17, 2002

(54) SASH LOCK ACTUATOR

(75) Inventors: Anthony J. Rotondi, Owatonna; Thomas J. Midas, Stillwater, both of MN (US)

(73) Assignee: Truth Hardware Corp., Owatonna, MN (US)

( * ) Notice: Subject to any disclaimer, the term of this patent is extended or adjusted under 35 U.S.C. 154(b) by 136 days.

(21) Appl. No.: 09/689,068

(22) Filed: Oct. 12, 2000

Related U.S. Application Data

(60) Provisional application No. 60/159,349, filed on Oct. 13, 1999.

(51) Int. Cl.[7] ..... E05C 1/06

(52) U.S. Cl. ..... 292/158; 292/139; 292/336.3; 292/DIG. 33

(58) Field of Search ..... 292/336.3, DIG. 33, 292/156–159, 161, 139, 143, 36, 40

(56) References Cited

U.S. PATENT DOCUMENTS

| | | | | | |
|---|---|---|---|---|---|
| 4,991,886 | A | * | 2/1991 | Nolte et al. | 292/161 |
| 5,318,333 | A | * | 6/1994 | Dreifert | 292/336.3 |
| 5,370,428 | A | * | 12/1994 | Dreifert et al. | 292/161 |
| 5,829,802 | A | * | 11/1998 | Anderson et al. | 292/336.3 |
| 5,927,767 | A | * | 7/1999 | Smith et al. | 292/158 |
| 6,109,668 | A | * | 8/2000 | Demarco | 292/161 |

* cited by examiner

*Primary Examiner*—Teri Pham Luu

(74) *Attorney, Agent, or Firm*—Lorusso & Loud

(57) ABSTRACT

An actuator having a housing with a pivot opening therein. An actuator handle has a pivot pin extending from an end thereof for connecting the handle to a crank which includes a drive pin. The handle is assembled to the housing with the pivot pin extending through the pivot opening. A bushing may be disposed between the pivot pin and the pivot opening to take up tolerances between the parts and provide smooth handle rotation. The drive pin on the crank extends into a drive slot on a slider which translates within the housing to actuate a window locking mechanism. The drive slot is generally pear-shaped with, preferably symmetrical, opposed curved sidewalls along which the drive pin rides during rotation of the handle. The slider may further include a pair of fulcrum tabs disposed on a top thereof adjacent opposite sides of the drive slot for contacting a side surface of the crank during rotation of the handle to provide mechanical advantage at the handle. A spring is provided with a bowed middle portion which extends beneath the slider and identical ends which extend above the slider at each side thereof One end of the spring provides the detent function by biasing the drive pin against one of the slider side walls. The other end of the spring extends upward to provide pick resistance by forming a physical barrier between a slot in the base portion of the housing and the crank, handle, and bushing. The actuator may be converted for single-point use, by providing a single point extension on the slider, either integrally or as a separate part. The single point extension has a latch opening for receiving a latch of a single-point locking mechanism during rotation of the handle. The latch opening may be defined by a pair of symmetrically curved arms which force the latch into the opening, and which provide non-handedness.

41 Claims, 7 Drawing Sheets

SASH LOCK ACTUATOR

This appln claims benefit of Prov. No. 60/159,349 filed Oct. 13, 1999.

FIELD OF THE INVENTION

The present invention relates in general to window sash locks, and in particular to a rotating lever-style sash lock actuator for a multi-point or single point window locking system.

BACKGROUND OF THE INVENTION

Conventionally, windows, such as casement or awning windows, are locked by manipulation of a lock actuator handle which causes corresponding motion in a catch. The actuator is affixed to a window frame so that the catch engages a keeper on a corresponding section of a movable window sash to securely hold the sash against the frame. Where only one keeper on the sash is engaged by a catch, the locking mechanism is referred to as a "single-point" locking mechanism.

Also known in the art are "multi-point" locking mechanisms, wherein operation of an actuator handle causes a plurality of catches to respectively engage a plurality of keepers at spaced locations on the sash. Such systems may include a tie bar assembly wherein operation of the actuator handle causes translation of a tie bar disposed on the window frame. As the sash approaches a closed position, translation of the tie bar causes engagement of a plurality of lock rollers/catches disposed on the tie bar with respective keepers on the sash, thereby locking the window.

It has been recognized that there are several features of a window sash lock which are particularly desirable, and which prior art actuators have not displayed. One desirable feature is smooth operation of the actuator for allowing facile locking with an even and non-excessive force. Due to the interaction of moving parts in conventional window locks, however, prior art lock actuators generally require abrupt changes in force required at the handle. These changes in force are imparted to the user during operation. In addition to being uncomfortable for a user, the substantial required force and uneven nature in which the force is experienced, can cause premature mechanical failure of the lock mechanism.

Another important feature of a window sash lock actuator is forced entry ("pick") resistance. To prevent the lock from being disengaged from outside of the sash, protection of the internal mechanism of the lock actuator is necessary. Several approaches to pick resistance have been attempted in prior art actuators. Unfortunately, however, such approaches have resulted in cumbersome and expensive designs. In addition, prior art designs have generally failed to provide efficient and cost-effective pick resistance in a "non-handed" actuator. A non-handed actuator is an actuator which allows lock operation regardless of the side of the window on which the actuator is mounted. Thus, in a non-handed actuator movement of the actuator handle in either direction of rotation may cause equal corresponding opposite movement in the catch or lock rollers.

Another desirable feature of a sash lock actuator is facile conversion of the actuator from a multi-point to a single-point actuator, and vice-versa. In prior art designs, the actuator has been particularly adapted to facilitate either multi-point mechanisms or single-point mechanisms. Manufacturing and installation efficiency is, however, improved by providing a single actuator which may be readily modified to accommodate either mechanism. This construction positively impacts window manufacturers in at least two ways: (1) it allows for reduced manufacturing and window preparation costs; and (2) it provides aesthetic enhancement since the lock has identical appearance in both multi-point and single point configuration, thereby providing a consistent and attractive appearance on both casement and awning windows.

Accordingly, there is a need in the art for an efficient and reliable sash lock actuator which allows for smooth and even lock actuation. There is also a need in the art for an efficient and reliable sash lock actuator which is pick-resistant and non-handed. There is also a need in the art for an efficient and reliable sash lock actuator which is convertible from multi-point to single point operation and vice-versa. There is a further need in the art for a sash lock actuator which offers consistent hardware application and appearance on a window.

SUMMARY OF THE INVENTION

Thus, the present invention is organized about the concept of providing an efficient and reliable sash lock actuator which exhibits smooth and even lock actuation., and which is pick-resistant, non-handed, and convertible from multi-point to single point operation. The actuator includes a housing with a pivot opening therein, which may be defined by portions of a separate cover and a base. An actuator handle has a pivot pin extending from an end thereof for connecting the handle to a crank which includes a drive pin. The handle is assembled to the housing with the pivot pin extending through the pivot opening. A bushing may be disposed between the pivot pin and the pivot opening, e.g., between the portions of the cover and base forming the pivot opening, to take up tolerances between the parts and provide smooth handle rotation.

The drive pin on the crank extends into a drive slot on a slider which translates within the housing to actuate a window locking mechanism. The drive slot is generally pear-shaped with, preferably symmetrical, opposed curved sidewalls along which the drive pin rides during rotation of the handle. The shape of the drive slot allows for smooth handle rotation, and the symmetry of the curved sidewalls allows the actuator to be non-handed for positioning on either side of a window frame. The slider may further include one or more fulcrum tabs disposed on a top thereof adjacent opposite sides of the drive slot for contacting a side surface of the crank during rotation of the handle. The fulcrum tabs provide mechanical advantage during rotation of the handle for forcing the slider to translate within the housing.

A spring is disposed within the housing for providing a detent function and for providing pick-resistance. The spring has a bowed middle portion which extends beneath the slider and identical ends which extend above the slider at each side thereof. Depending on the direction of handle rotation, one end of the spring provides the detent function by biasing the drive pin against one of the slider side walls. The other end extends upward to provide a physical barrier between a slot in the base portion of the housing and the crank, handle, and bushing. The physical barrier in combination with the cover, which is preferably closed on three sides, prevents the use of a "pick-tool" for providing pick resistance.

Finally, the actuator may be provided with an optional single-point slider extension. The single point extension may be disposed on the slider, either integrally or as a separate part, for directing a latch of a single-point locking mechanism into a latch opening in the extension during rotation of the handle. The latch opening may be defined by a pair of symmetrically curved arms which force the latch into the opening, and which provide non-handedness.

In particular, a sash lock actuator in accordance with the present invention may generally include a housing having a pivot opening therein and a pivot pin disposed at least partially within the pivot opening. The pivot pin has an actuator handle extending from a first end thereof and a crank extending from a second end thereof. The crank may be disposed at least partially within an interior cavity of the housing. A drive pin extends from a distal end of the crank and into a drive slot of a slider. The slider may have a first end disposed at least partially within the interior cavity and a second end adapted for engaging the locking mechanism. Upon rotation of the handle in a first direction, the slider is forced linearly relative to the housing in a second direction by engagement of the drive pin with a side wall of the slider.

According to one aspect of the invention, the drive slot may be defined by opposed curved side walls, the side walls curving inward from a relatively wide bottom of the slot and then outward to form a relatively narrow top of the slot. This slot geometry allows for smooth and even torque at the handle for operating the actuator.

According to another aspect of the invention, the slider may further include at least one fulcrum tab extending from a top thereof, the fulcrum tab being positioned on the slider for contacting a side surface of the crank for providing mechanical advantage upon rotation of the handle. In one embodiment, the slider may have first and second fulcrum tabs extending from a top thereof, the fulcrum tabs being positioned adjacent opposite sides of the slot, whereby upon rotation of the handle a side surface of the crank contacts one of the fulcrum tabs.

According to a further aspect of the invention, the actuator may include a spring disposed within the interior cavity. The spring may have a middle portion extending beneath the slider and first and second ends extending above a top surface of the slider. Upon rotation of the handle, the spring contacts the slider and moves linearly within the cavity with the slider. Upon maximum rotation of the handle in the first direction, the first end of the spring contacts an interior surface of the housing to bias the slider in a direction opposite to the second direction, the spring thereby forcing the drive pin against one of the curved side walls for detenting rotation of the handle in a direction opposite to the first direction. Also, with maximum rotation of the handle in the first direction, the second end of the spring is disposed adjacent the first end of the crank, the spring thereby forming a barrier between an opening in the housing through which the slider extends and the first end of the crank and the pivot pin. In one embodiment, the first and second ends of the spring may include a first flat portion, an upwardly extending angular portion extending from a first end of the first flat portion, an upwardly extending portion extending form an end of the angular portion, and a downwardly extending portion extending from a second end of the first flat portion. At least one of the downwardly extending portions is positioned to contact a side surface of the slider to cause linear movement of the spring with movement of the slider.

The housing of the actuator may comprise a cover and a base, the cover having portions defining a first portion of the pivot opening and the base having portions defining a second portion of the pivot opening. The base mates with the cover for forming the housing with the first and second portions of the pivot openings mating to form the pivot opening. The cover may have a top side wall having the portions defining the first portion of the pivot opening, a bottom side wall, an end side wall, and an open end. The base may have a slot therein, the base being adapted to mate with the housing for closing the open end with at least a portion of the slider extending through the slot. Also, the slider may have a slider guide rail extending therefrom, the slider guide rail being disposed in a slider guide rail slot defined by a shelf formed in an interior surface of the cover and an end surface of the base.

A bushing may be disposed between the pivot pin and the pivot opening for taking up tolerances between the pivot pin and the pivot opening and thereby facilitating smooth handle rotation. The bushing may include first and second halves joined at a hinge point. The first and second halves may have a partially cylindrical portion with a radially extending flange at a top of the cylindrical portion.

Advantageously, the slider may include a pair of legs defining a slot for engaging the locking mechanism, e.g., a multi-point locking mechanism, or it may include a single-point extension adapted for engaging a single-point locking mechanism. The single point extension may have a pair of arms and a latch opening for receiving a single point latch. Each of the arms may have a curved end surface for contacting the single point latch and directing the single point latch into the latch opening upon rotation of the handle.

BRIEF DESCRIPTION OF THE DRAWING

For a better understanding of the present invention, together with other objects, features and advantages reference should be made to the following detailed description which should be read in conjunction with the following figures wherein like numerals represent like parts.

DETAILED DESCRIPTION OF THE INVENTION

Figure 1:
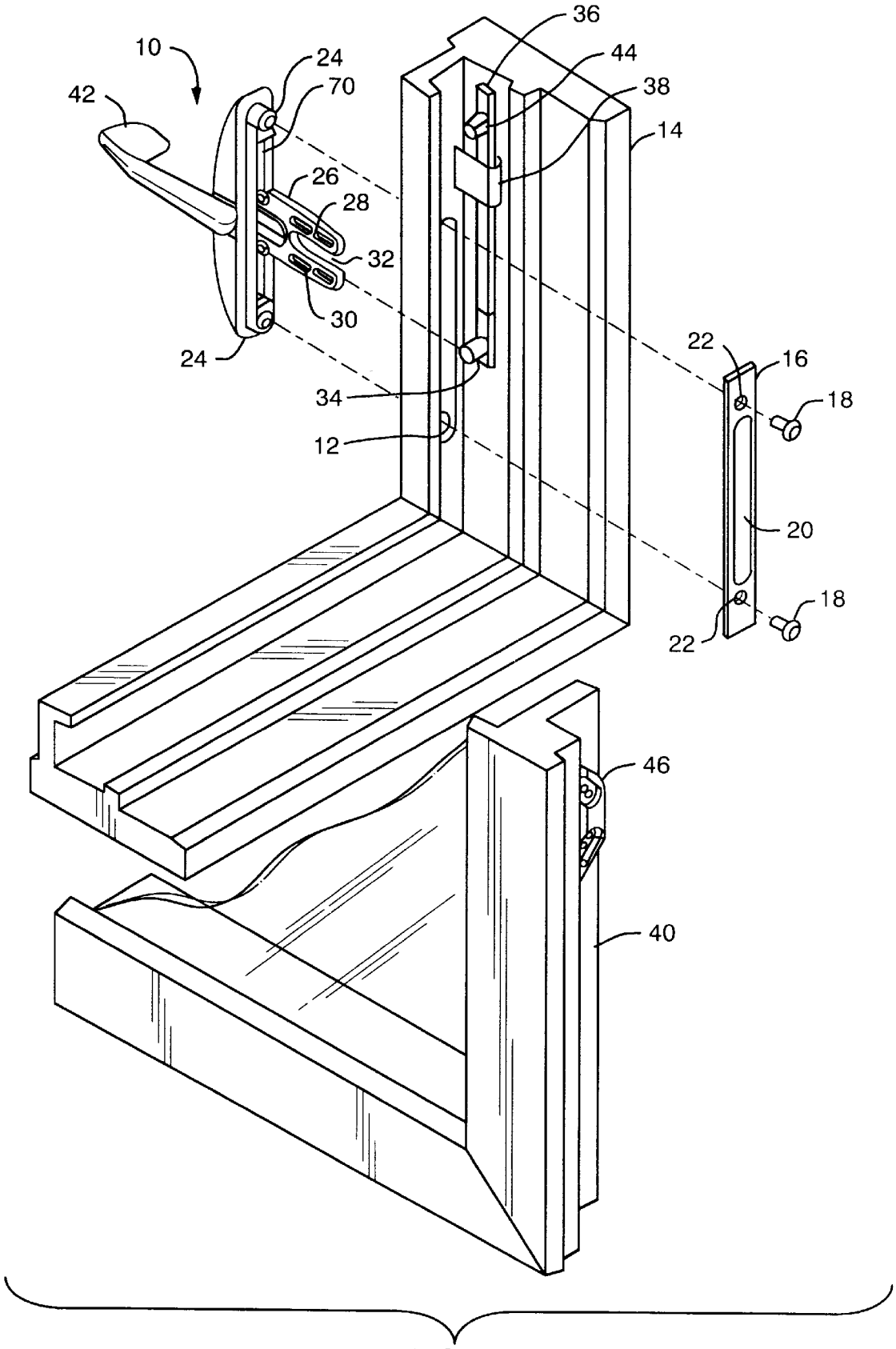
FIG. 1: is a perspective view of a portion of a window showing an exemplary sash lock actuator in accordance with the present invention in exploded view orientation to a mounting position in the window.

FIG. 1 illustrates an exemplary sash lock actuator 10 in accordance with the present invention in exploded relation relative to a mounting opening 12 in a window frame 14. As shown, the actuator 10 may be securely mounted within the opening 12 by aligning a face plate 16 with the actuator on an opposite side of the opening and passing fasteners 18, e.g., screws, through openings 22 in the face plate in alignment with corresponding openings 24 in the actuator. Those skilled in the art will recognize, however, that the actuator may be appropriately mounted to a window frame without a face plate, e.g., by fasteners through corresponding openings formed in the window frame.

In the illustrated embodiment, a portion of a slider 26 on the actuator passes through the opening 12 and the corresponding opening 20 in the face plate. The slider includes a pair of legs 28, 30 which define a slot 32 for engaging a locking mechanism. Those skilled in the art will recognize that a variety of locking mechanisms may be actuated by an actuator in accordance with the invention. However, in the depicted embodiment, the slot 32 engages a bottom lock roller 34 secured to a tie bar 36 which is slidingly affixed to the window frame by a tie bar guide 38.

When the movable sash 40 closes to the window frame, a handle 42 on the actuator is rotated to cause corresponding opposite direction movement in the slider 26. Engagement of the slot 32 with the bottom lock roller 34 causes linear movement of the tie bar 36 in the direction of slider movement. In a manner known in the art, linear movement of a top lock roller 44 on the tie bar causes engagement of the top lock roller with a keeper 46 secured to the window sash 40. When the top lock roller and the keeper are fully engaged, the sash 40 is locked to the window frame 14. Unlocking of the sash is accomplished by rotating the actuator handle 42 in an opposite direction to force linear movement of the tie bar and disengage the top lock roller 44 from the keeper 46.

Figure 2:
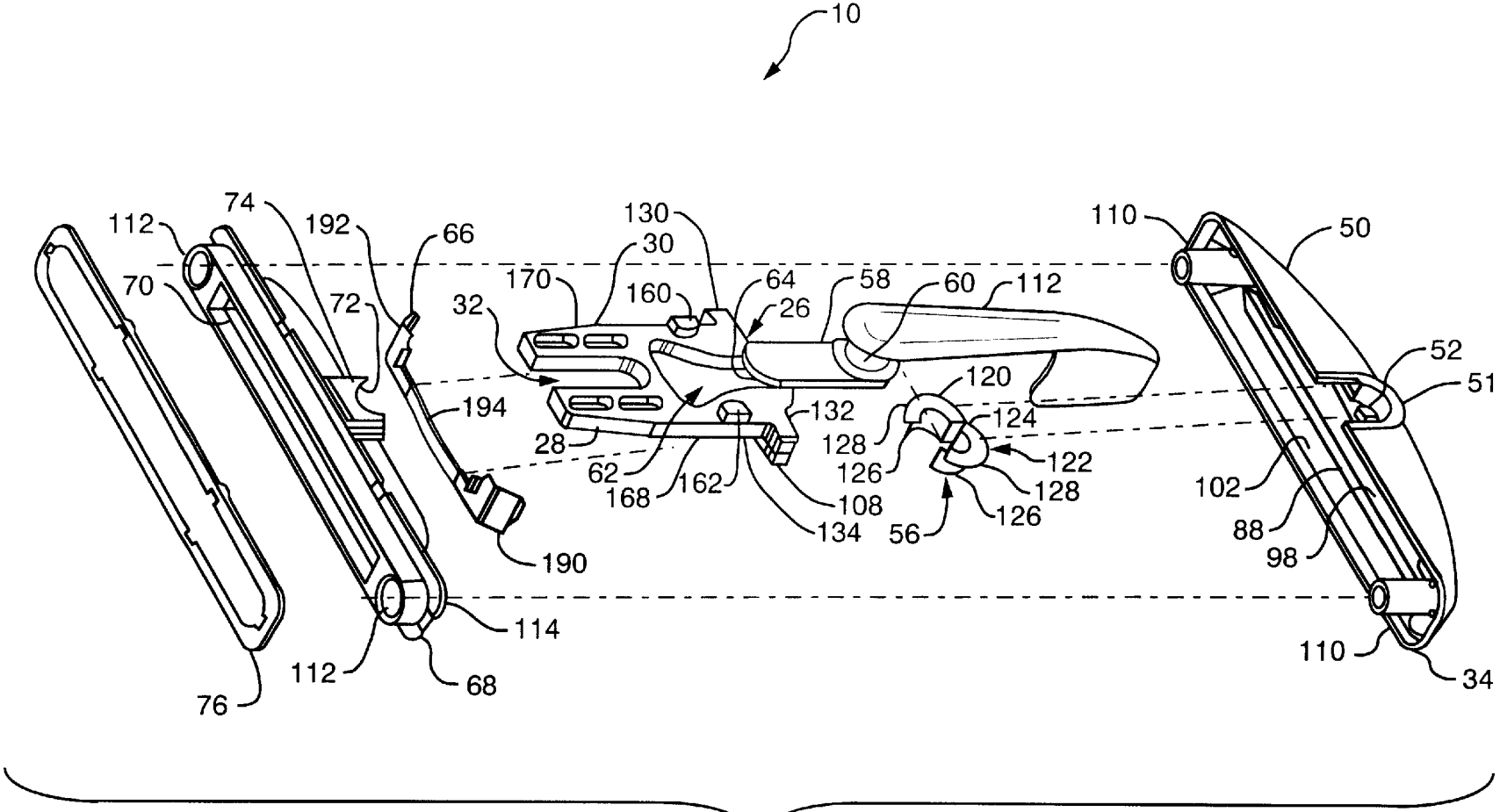
FIG. 2: is an exploded view of an exemplary sash lock actuator in accordance with the present invention.

Turning now to FIG. 2, there is shown an exploded view of an exemplary sash lock actuator 10 in accordance with the present invention. As shown, an exemplary actuator includes: a cover 50 having an open end 54 and portions 51 defining a first portion 52 of a pivot opening; a bushing 56; a handle 42 secured to a crank 58 through a pivot pin 60; a slider 26 having portions defining a guide slot 62 for receiving a drive pin 64 on the crank; a spring 66; a base 68 having an elongate slot 70 through which a portion of the slider may pass and portions 74 defining a second portion 72 of the pivot opening; and a gasket 76.

Figure 4:
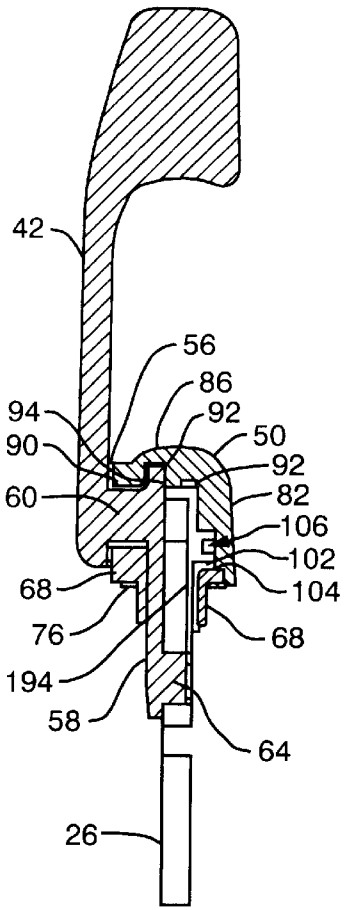
FIG. 4: is a sectional view of the actuator shown in FIG. 3, taken along lines 4—4.
Figure 3:
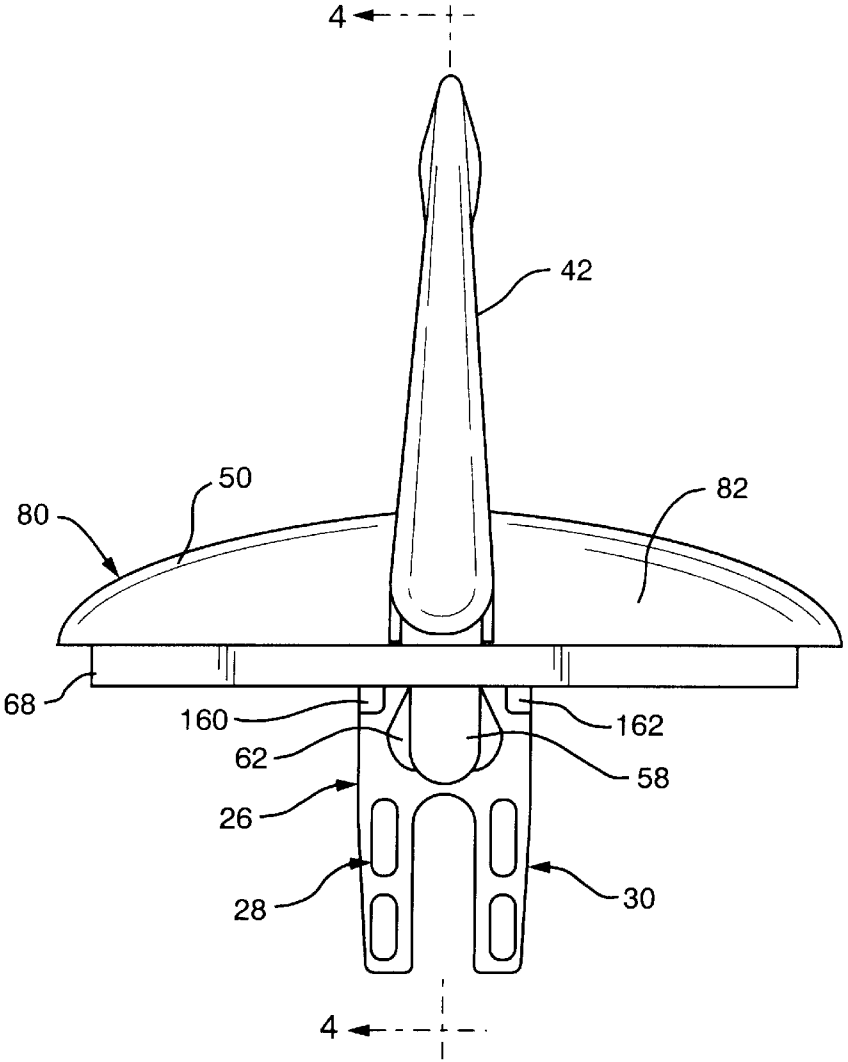
FIG. 3: is a top view of the exemplary sash lock actuator shown in FIG. 2.

With reference also to FIGS. 3 and 4, the actuator housing may be formed by the mating engagement of the cover 50 and the base plate 68. The cover 50 may be die-cast as a single piece from, e.g., zinc, and is preferably open only to the underside after installation of the handle. In the illustrated embodiment, the cover includes top 82, bottom 84, and side 86 portions which define an interior cavity 88 (FIG. 1). The top 82 includes portions 51 defining the first pivot opening portion 52 which is adapted to mate with the second pivot opening portion 72 on the base 68 to form a pivot opening 90 through which the pivot pin 60 on the handle extends, as shown particularly in FIG. 4. A slot 92 may be defined in the interior surface of the top portion 86 adjacent the first portion 52 of the pivot opening for receiving the end 94 of the crank 58.

Figure 6:
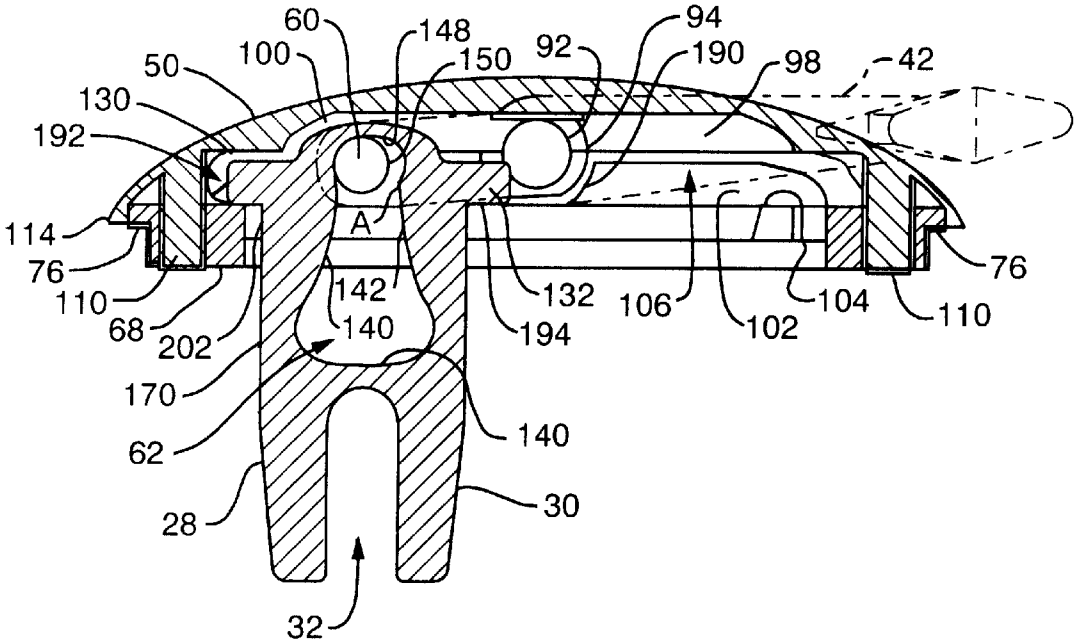
FIG. 6: is a sectional view of the actuator shown in FIG. 5, taken along lines 6—6.
Figure 5:
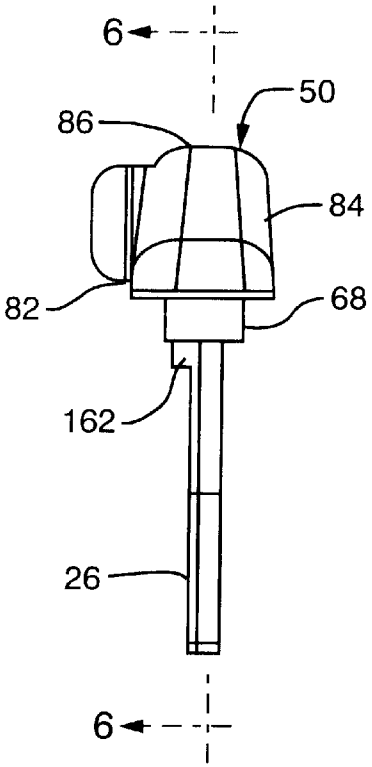
FIG. 5: is a side view of the an exemplary sash lock actuator in accordance with the present invention.

The interior surface of the bottom portion 84, as shown more particularly in FIGS. 5 and 6, may include a first elongate shelf portion 98 for supporting a curved top 100 of the slider for translation from a first end of the cover 50 to a second end. A second elongate shelf portion 102 may be defined in the interior surface of the bottom portion for forming a slider guide slot 106 in combination with a bottom end surface 104 of the base. The slider guide slot 106 receives a slider guide rail 108 on a bottom surface of the slider 26 for guiding the slider for translation along the length of the cover.

In the illustrated embodiment, the base 68 mates with the cover 50 with fastening lugs 110 on the cover passing through corresponding openings 112 in the base. The base closes the open end of the cover so that the opening thereto is the elongate slot 70 in the base, through which a portion of the slider and the crank extend when the assembly is complete. An outside surface of a flange 114 on the base mates flush with the end surface 54 of the cover, and the gasket 76 may be provided on the outside surface of the flange to facilitate proper mounting of the actuator to a window frame.

The pivot opening 90 for the pivot pin 60 is formed by the combination of the first portion 52 of the pivot opening on the cover and the corresponding second portion 72 of the pivot opening on the base. To account for design tolerances between the pivot opening size and the pivot pin, the bushing 56 is provided. As shown particularly in FIG. 2, the bushing 56 may be a molded plastic part having a first portion 120 and a second portion 122 connected end-to-end for hinged movement at the connection point 124. The first portion and second portion may be identical, each with a partially cylindrical base portion 126 and a radially extending flange 128 at the top thereof which acts as a bearing surface for the rotation of the handle. As the actuator is assembled, the bushing 56 is placed into the first portion 52 of the pivot opening with the pivot pin 60 disposed in the opening between the first and second portions of the bushing. The portions 74 of the base defining the second portion 72 of the pivot opening force the first and second portions of the bushing to close together around the pivot pin 60 as the base and the cover are joined together. The bushing 56 is thereby disposed between the pivot pin 60 and the combined base and cover, as shown in FIG. 4, to account for design tolerances between the mating base and cover and thereby improve the ease of pivot pin and handle rotation.

Referring still to FIG. 2, translation of the slider within the cover 26 is achieved by rotation of the handle, which connects to the crank 58 through the pivot pin 60. These parts may be formed from zinc die-cast as a single piece, or may be joined together as separate pieces. As will be recognized by those skilled in the art, the shape of the handle can take a variety of forms depending primarily on style and user comfort. The crank may be a generally flat piece with a drive pin 64 extending from a distal end thereof for engaging the slider drive slot 62.

In the illustrated embodiment, the slider 26 may be a generally flat and formed from zinc die-cast. The slider may include the curved top portion 100 which rides along the shelf 98 in the interior surface of the bottom portion of the cover. First 130 and second 132 arms extend outward from each side of the slider, and the slider guide rail 108 extends downward from the bottom 134 of the slider in alignment with the first 130 and second 132 arms. At an opposite end of the slider the slot 32 is defined between the legs 28,30 for receiving and transmitting motion to the locking mechanism upon rotation of the handle. Those skilled in the art will recognize that the lengths of the legs and the slot may be adjusted to account for the distance to the locking mechanism in any particular application.

The slider drive slot 62, a shown for example in FIG. 6, is generally pear-shaped with opposed curved side walls 140, 142 which are preferably symmetrically curved about a longitudinal axis of the slot. As shown, the bottom 146 of the slot is substantially wider than a top 148 of the slot, with each of the sidewalls curving generally inward from the bottom toward the longitudinal axis causing a decreasing slot width. In the illustrated embodiment, the initial curvature of the side walls ceases and the walls curve outward relative to the longitudinal axis at about point A to form a head 150 for receiving the drive pin 60 when the handle is rotated to the extremes of its motion, as shown in FIG. 6 with the handle shown in phantom lines. As will be described in more detail below, the ;change in the curvature at point A also acts in combination with the spring 66 to detent the slider when the handle is rotated to its extreme positions.

As the handle is rotated about the pivot pin 60, the drive pin travels along one of the side walls 140 or 142 depending on the direction of rotation. The drive pin forces translation of the slider relative to the housing with the slider guide rail 108 traveling in the slider guide slot 106 in a direction opposite to the direction of rotation of the handle. Advantageously, the curved side walls 140, 142 allow for substantially constant required torque at the handle for forcing the slider from a first central position, as shown in FIG. 3, to an extreme position adjacent an end of the cover, as shown in FIG. 6. Also, the symmetry of the opposed curved side walls 140, 142 allows for the substantially identical required force for movement of the handle in either direction of rotation. Thus, the actuator is "non-handed" since it may be positioned on either side of a window frame for rotation of the handle in any direction with corresponding opposite direction linear motion in the slider.

Figure 7:
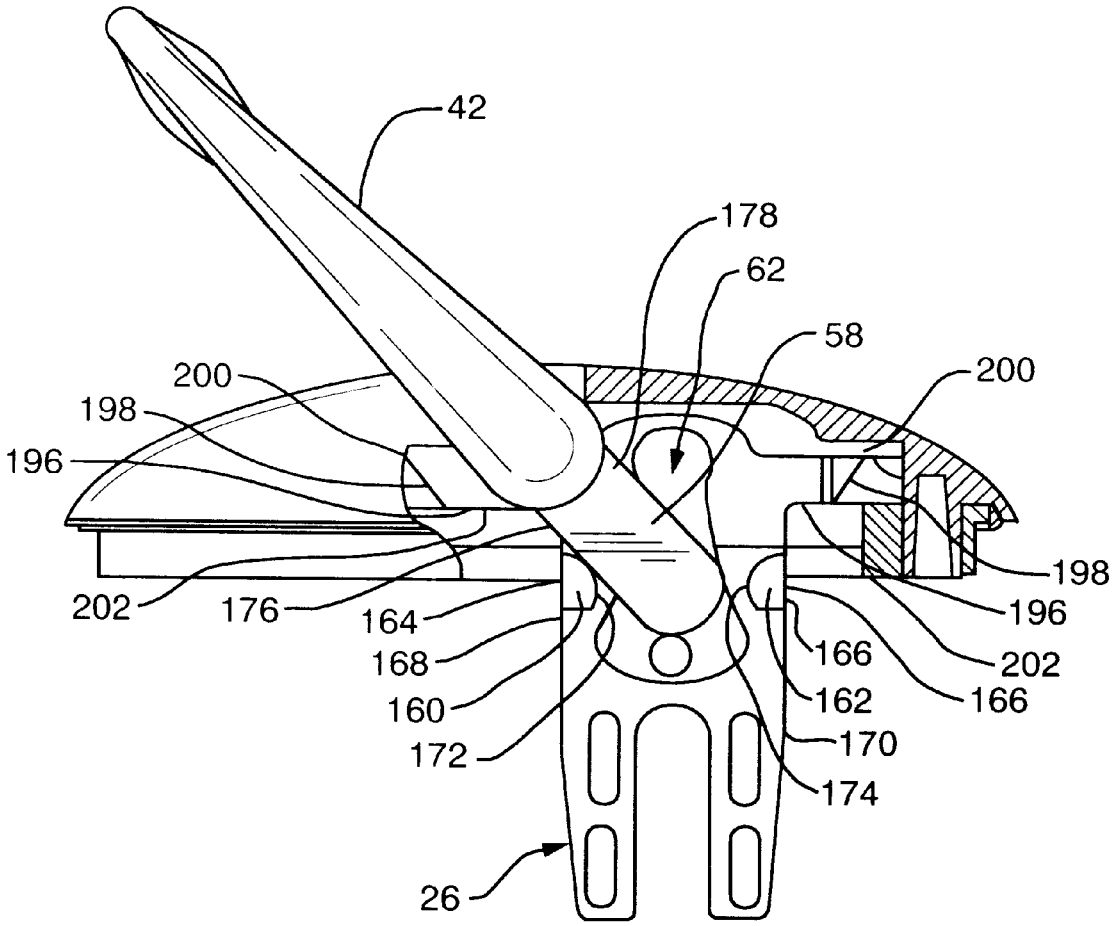
FIG. 7: is a top partial sectional view of an exemplary actuator in accordance with the present invention.

As shown particularly in FIG. 7, the slider may further include a pair of fulcrum tabs 160, 162 extending from the top surface thereof The tabs may be positioned with side surfaces 164, 166 adjacent the sides 168, 170 of the slider and with opposed curved surfaces 172, 174 facing the longitudinal axis of the slot 62. Advantageously, the fulcrum tabs are positioned relative to the slot so that when increasing torque at the handle is required to move the drive pin along the guide slot, a side surface 176, 178 of the crank will contact one of the curved surfaces, depending on the direction of rotation of the handle, as shown in FIG. 7.

The curved surfaces 172, 174 of the tabs 160,162 thus act as a fulcrum for the crank 58, whereby mechanical advantage is achieved to overcome the increasing required torque at the handle 42. The fulcrum tabs 160, 162 are positioned symmetrically on either side of the slider 26 so that in either direction of handle rotation, the crank may engage a tab 160 or 162 to provide mechanical advantage. Advantageously, the symmetrically curved shape of the slider slot and engagement of the crank side walls with the tabs allow for smooth handle rotation with relatively even torque throughout the range of handle rotation.

Turning again to FIG. 2, the spring 66 may be formed from spring steel (stainless) and is provided with first 190 and second 192 identical ends separated by a bowed middle portion 194. As shown more particularly for example in FIG. 8, each end of the spring has a first flat portion 196 and an angularly upwardly extending portion 198 at a first end of the flat portion. An upwardly extending portion 200 extends from an end of the angularly extending portion 198 in a direction approximately perpendicular to the first flat portion, and a downwardly extending portion 202 extends from a second end of the flat portion in a direction approximately perpendicular to the first flat portion 196.

The spring is sized to extend beneath the slider 26 with the bowed middle portion 194 positioned adjacent the front surface of the slider guide rail 108 in the slider guide slot, as shown in FIG. 4. The ends 190, 192 of the spring extend upward on each side of the slider above the top surface of the slider. The downwardly extending tabs 202 are thus positioned adjacent the side surfaces 170, 168 of the slider.

As the slider moves linearly in the slider guide slot 106, a side surface, e.g., 170, of the slider contacts one of the downwardly extending portions 202, as shown in FIG. 6, thereby forcing corresponding linear motion of the spring. When the handle reaches a maximum rotation position as shown in phantom lines in FIG. 6, the first end 192 of the spring is forced against the interior surface of the cover and deforms to create a bias against the force imparted by the handle through the pin 60. The pin is thereby forced into pressing engagement with the side wall, e.g., 140, of the head 150 of the slot. Under this condition, the spring bias and the change in slot curvature at about point A detents movement of the pin 60 out of the head 150 of the slot and, correspondingly, detents rotation of the handle in an opposite direction, i.e., in a direction to the left in FIG. 6. The detent provided by the spring force and the change in slot curvature may be overcome by user rotation of the handle, but is preferably sufficient to prevent inadvertent rotation of the handle.

When the pin is detented within the head of the slot 150, as shown, the opposite end of the spring 190 is positioned adjacent the end 94 of the crank. The opposite end of the spring thereby presents a physical barrier between the slot 70 in the base plate and the end of the crank 94, the bushing 56, the pivot pin 60, and the handle 42. Advantageously, therefore, in addition to providing a detent function between the slider and the handle, the spring 66 provides "pick-resistance" by substantially blocking access to the pivot pin and handle which would allow use of a "pick tool" for back driving the handle through the slot in the base.

Figure 8:
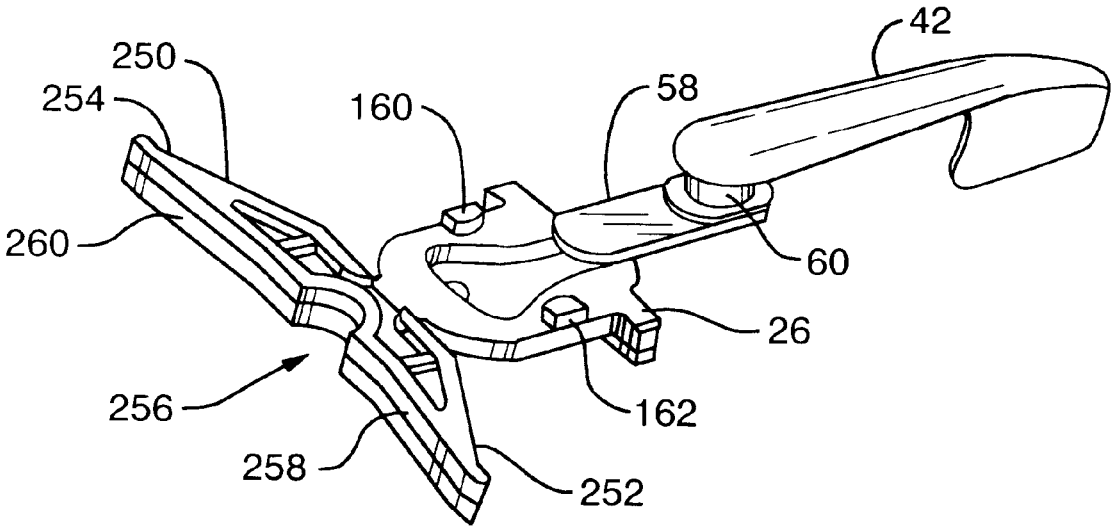
FIG. 8: is a perspective view of an exemplary handle and slider in accordance with the invention wherein the slider includes a single-point extension extending from the end thereof.
Figure 9:
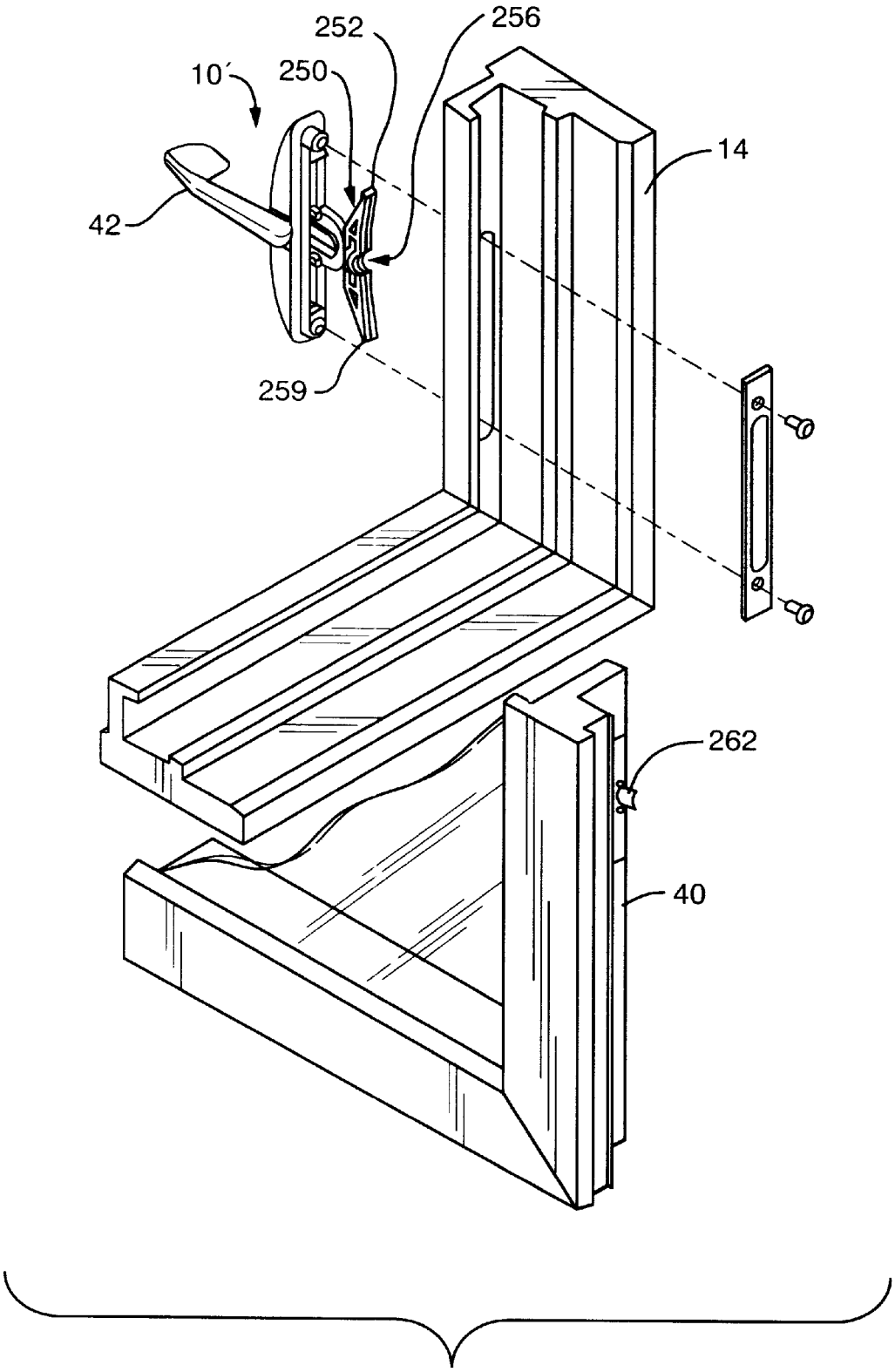
FIG. 9: is a perspective view of a portion of a window showing an exemplary single-point sash lock actuator in accordance with the present invention in exploded view orientation to a mounting position in the window.

Another exemplary embodiment of an actuator 10' according to the invention is illustrated in FIGS. 8 and 9. As shown, the slider 26' for an actuator according to the invention may be readily modified to provide a single-point extension 250 for actuating a single point locking mechanism. In the illustrated embodiment, the extension 250 is shown as being an integral part of a modified slider 26', which may zinc die-cast. It is to be understood, however, that the extension 250 may be a separate part which is attached to a slider by one or more fasteners, e.g., screws.

The single-point extension preferably has a pair of outwardly extending arms 252, 254 defining a latch opening 256 therebetween. The arms have curved end surfaces 258,260 for engaging a latch 262 on the window sash 40, and for directing the latch 262 into the latch opening 256 upon rotation of the handle 42. To provide for "non-handed" operation the arms 252,254 may be symmetrical relative to the latch opening 256.

There is thus provided an efficient and reliable sash lock actuator which exhibits smooth and even lock actuation, and which is pick-resistant, non-handed, and convertible from multipoint to single point operation. The actuator may include a cover and a base which are joined to form an actuator housing with a pivot opening defined between the actuator and base. An actuator handle has a pivot pin extending from an end thereof for connecting the handle to a crank which includes a drive pin. The handle is assembled to the housing with the pivot pin extending through the pivot opening. A bushing may be disposed between the pivot pin and the portions of the cover and base forming the pivot opening to take up tolerances between the parts and provide smooth handle rotation.

The drive pin on the crank extends into a drive slot on a slider which translates within the housing to actuate a window locking mechanism. The drive slot is generally pear-shaped with, preferably symmetrical, opposed curved sidewalls along which the drive pin rides during rotation of the handle. The shape of the drive slot allows for smooth handle rotation, and the symmetry of the curved sidewalls allows the actuator to be non-handed for positioning on either side of a window frame. The slider may further include one or more fulcrum tabs disposed on a top thereof adjacent opposite sides of the drive slot for contacting a side surface of the crank during rotation of the handle. The fulcrum tabs provide mechanical advantage during rotation of the handle for forcing the slider to translate within the housing.

A spring may be disposed within the housing for providing a detent function and for providing pick-resistance. The spring has a bowed middle portion which extends beneath the slider and identical ends which extend above the slider at each side thereof. Depending on the direction of handle rotation, one end of the spring provides the detent function by biasing the drive pin against one of the slider side walls. The other end extends upward to provide a physical barrier between a slot in the base portion of the housing and the crank, handle, and bushing. The physical barrier in combination with the cover, which is preferably closed on three sides, prevents the use of a "pick-tool" for providing the actuator with pick resistance.

Finally, the actuator may be provided with an optional single-point slider. A single point extension may be disposed on the slider, either integrally or as a separate part, for directing a latch of a single-point locking mechanism into a latch opening in the extension during rotation of the handle. The latch opening may be defined by a pair of symmetrically curved arms which force the latch into the opening, and which provide non-handedness.

The embodiments which have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. A sash lock actuator for actuating a window locking mechanism for locking a movable sash to a window frame, said actuator comprising:

a housing having a pivot opening therein;

a pivot pin disposed at least partially within said pivot opening, said pivot pin having a handle extending from a first end thereof and a crank extending from a second end thereof, said crank being disposed at least partially within an interior cavity of said housing; and a drive pin extending from a distal end of said crank and into a drive slot of a slider, said slider having a first end disposed at least partially within said interior cavity and a second end adapted for engaging said locking mechanism, wherein said drive slot is defined by opposed curved side walls, said side walls curving inward from a relatively wide bottom of said slot and then outward to form a relatively narrow top of said slot; and wherein upon rotation of said handle in a first direction, said slider is forced linearly relative to said housing in a second direction by engagement of said drive pin with one of said curved side walls.

2. A sash lock actuator according to claim 1, wherein said housing comprises a cover and a base, said cover having portions defining a first portion of said pivot opening and said base having portions defining a second portion of said pivot opening, and wherein said base mates with said cover for forming said housing with said first and second portions of said pivot openings mating to form said pivot opening.

3. A sash lock actuator according to claim 2, wherein said cover has a top side wall having said portions defining said first portion of said pivot opening, a bottom side wall, an end side wall, and an open end, and wherein said base has a slot therein, said base being adapted to mate with said housing for closing said open end with at least a portion of said slider extending through said slot.

4. A sash lock actuator according to claim 2, wherein said slider has a slider guide rail extending therefrom, said slider guide rail being disposed in a slider guide rail slot defined by a shelf formed in an interior surface of said cover and an end surface of said base.

5. A sash lock actuator according to claim 1, said actuator further comprising a bushing disposed between said pivot pin and said pivot opening.

6. A sash lock actuator according to claim 5, wherein said bushing comprises first and second halves joined at a hinge point, each of said first and second halves comprising a partially cylindrical portion with a radially extending flange at a top of said cylindrical portion.

7. A sash lock actuator according to claim 1, wherein said second end of said slider includes a pair of legs defining a slot for engaging said locking mechanism.

8. A sash lock actuator according to claim 1, wherein said second end of said slider comprises a single-point extension, said single-point extension having a pair of arms and a latch opening for receiving a single point latch of said locking mechanism.

9. A sash lock actuator according to claim 8, wherein each of said arms has a curved end surface for contacting said single point latch and directing said single point latch into said latch opening upon rotation of said handle.

10. A sash lock actuator according to claim 1, said actuator further comprising a spring disposed within said interior cavity, said spring having a middle portion extending beneath said slider and first and second ends extending above a top surface of said slider, wherein upon rotation of said handle said spring contacts said slider and moves linearly within said cavity with said slider, and wherein upon maximum rotation of said handle in said first direction said first end of said spring contacts an interior surface of said housing to bias said slider in a direction opposite to said second direction, said spring thereby forcing said drive pin against one of said curved side walls for detenting rotation of said handle in a direction opposite to said first direction.

11. A sash lock actuator according to claim 10, wherein upon maximum rotation of said handle in said first direction said second end of said spring is disposed adjacent said first end of said crank, said spring thereby forming a barrier between an opening in said housing through which said slider extends and said first end of said crank and said pivot pin.

12. A sash lock actuator according to claim 11, wherein said first and second ends of said spring comprise a first flat portion, an upwardly extending angular portion extending from a first end of said first flat portion, an upwardly extending portion extending from an end of said angular portion, and a downwardly extending portion extending from a second end of said first flat portion, and wherein at least one of said downwardly extending portions is positioned to contact a side surface of said slider to cause linear movement of said spring with movement of said slider.

13. A sash lock actuator according to claim 1, wherein said slider has at least one fulcrum tab extending from a top thereof, said fulcrum tab being positioned on said slider for contacting a side surface of said crank upon rotation of said handle.

14. A sash lock actuator according to claim 1, wherein said slider has first and second fulcrum tabs extending from a top thereof, said fulcrum tabs being positioned adjacent opposite sides of said slot, whereby upon rotation of said handle a side surface of said crank contacts one of said fulcrum tabs.

15. A sash lock actuator for actuating a window locking mechanism for locking a movable sash to a window frame, said actuator comprising:

a housing having a pivot opening therein;

a pivot pin disposed at least partially within said pivot opening, said pivot pin having a handle extending from a first end thereof and a crank extending from a second end thereof, said crank being disposed at least partially within an interior cavity of said housing; and a drive pin extending from a distal end of said crank and into a drive slot of a slider, said slider having a first end disposed at least partially within said interior cavity and a second end adapted for engaging said locking mechanism, wherein said slider has at least one fulcrum tab extending from a top thereof; and wherein upon rotation of said handle in a first direction, a side surface of said crank contacts at least one of said at least one fulcrum tabs for providing mechanical advantage at said handle for forcing said slider linearly relative to said housing in a second direction.

16. A sash lock actuator according to claim 15, wherein said slider has first and second ones of said fulcrum tabs, said first and second fulcrum tabs being positioned adjacent opposite sides of said slot.

17. A sash lock actuator according to claim 15, wherein said drive slot is defined by opposed curved side walls, said side walls curving inward from a relatively wide bottom of said slot and then outward to form a relatively narrow top of said slot.

18. A sash lock actuator according to claim 15, wherein said housing comprises a cover and a base, said cover having portions defining a first portion of said pivot opening and said base having portions defining a second portion of said pivot opening, and wherein said base mates with said cover for forming said housing with said first and second portions of said pivot openings mating to form said pivot opening.

19. A sash lock actuator according to claim 18, wherein said cover has a top side wall having said portions defining said first portion of said pivot opening, a bottom side wall, an end side wall, and an open end, and wherein said base has a slot therein, said base being adapted to mate with said housing for closing said open end with at least a portion of said slider extending through said slot.

20. A sash lock actuator according to claim 18, wherein said slider has a slider guide rail extending therefrom, said slider guide rail being disposed in a slider guide rail slot defined by a shelf formed in an interior surface of said cover and an end surface of said base.

21. A sash lock actuator according to claim 15, said actuator further comprising a bushing disposed between said pivot pin and said pivot opening.

22. A sash lock actuator according to claim 21, wherein said bushing comprises first and second halves joined at a hinge point, each of said first and second halves comprising a partially cylindrical portion with a radially extending flange at a top of said cylindrical portion.

23. A sash lock actuator according to claim 15, wherein said second end of said slider includes a pair of legs defining a slot for engaging said locking mechanism.

24. A sash lock actuator according to claim 15, wherein said second end of said slider comprises a single-point extension, said single-point extension having a pair of arms and a latch opening for receiving a single point latch of said locking mechanism.

25. A sash lock actuator according to claim 24, wherein each of said arms has a curved end surface for contacting said single point latch and directing said single point latch into said latch opening upon rotation of said handle.

26. A sash lock actuator according to claim 15, said actuator further comprising a spring disposed within said interior cavity, said spring having a middle portion extending beneath said slider and first and second ends extending above a top surface of said slider, wherein upon rotation of said handle said spring contacts said slider and moves linearly within said cavity with said slider, and wherein upon maximum rotation of said handle in said first direction said first end of said spring contacts an interior surface of said housing to bias said slider in a direction opposite to said second direction, said spring thereby forcing said drive pin against a side wall of said drive slot for detenting rotation of said handle in a direction opposite to said first direction.

27. A sash lock actuator according to claim 26, wherein upon maximum rotation of said handle in said first direction said second end of said spring is disposed adjacent said first end of said crank, said spring thereby forming a barrier between an opening in said housing through which said slider extends and said first end of said crank and said pivot pin.

28. A sash lock actuator according to claim 27, wherein said first and second ends of said spring comprise a first flat portion, an upwardly extending angular portion extending from a first end of said first flat portion, an upwardly extending portion extending from an end of said angular portion, and a downwardly extending portion extending from a second end of said first flat portion, and wherein at least one of said downwardly extending portions is positioned to contact a side surface of said slider to cause linear movement of said spring with movement of said slider.

29. A sash lock actuator for actuating a window locking mechanism for locking a movable sash to a window frame, said actuator comprising:

a housing having a pivot opening therein, a pivot pin disposed at least partially within said pivot opening, said pivot pin having a handle extending from a first end thereof and a crank extending from a second end thereof, said crank being disposed at least partially within an interior cavity of said housing;

a drive pin extending from a distal end of said crank and into a drive slot of a slider, said slider having a first end disposed at least partially within said interior cavity and a second end adapted for engaging said locking mechanism; and a spring disposed within said interior cavity, said spring having a middle portion extending beneath said slider and first and second ends extending above a top surface of said slider, wherein upon rotation of said handle said spring contacts said slider and moves linearly within said cavity with said slider, and wherein upon maximum rotation of said handle in said first direction said first end of said spring contacts an interior surface of said housing to bias said slider in a direction opposite to said second direction, said spring thereby forcing said drive pin against a side wall of said slot for detenting rotation of said handle in a direction opposite to said first direction; and wherein upon maximum rotation of said handle in said first direction said second end of said spring is disposed adjacent said first end of said crank, said spring thereby forming a barrier between an opening in said housing through which said slider extends and said first end of said crank and said pivot pin.

30. A sash lock actuator according to claim 29, wherein said first and second ends of said spring comprise a first flat portion, an upwardly extending angular portion extending from a first end of said first flat portion, an upwardly extending portion extending from an end of said angular portion, and a downwardly extending portion extending from a second end of said first flat portion, and wherein at least one of said downwardly extending portions is positioned to contact a side surface of said slider to cause linear movement of said spring with movement of said slider.

31. A sash lock actuator according to claim 29, wherein said drive slot is defined by opposed curved side walls, said side walls curving inward from a relatively wide bottom of said slot and then outward to form a relatively narrow top of said slot.

32. A sash lock actuator according to claim 29, wherein said housing comprises a cover and a base, said cover having portions defining a first portion of said pivot opening and said base having portions defining a second portion of said pivot opening, and wherein said base mates with said cover for forming said housing with said first and second portions of said pivot openings mating to form said pivot opening.

33. A sash lock actuator according to claim 32, wherein said cover has a top side wall having said portions defining said first portion of said pivot opening, a bottom side wall, an end side wall, and an open end, and wherein said base has a slot therein, said base being adapted to mate with said housing for closing said open end with at least a portion of said slider extending through said slot.

34. A sash lock actuator according to claim 32, wherein said slider has a slider guide rail extending therefrom, said slider guide rail being disposed in a slider guide rail slot defined by a shelf formed in an interior surface of said cover and an end surface of said base.

35. A sash lock actuator according to claim 29, said actuator further comprising a bushing disposed between said pivot pin and said pivot opening.

36. A sash lock actuator according to claim 35, wherein said bushing comprises first and second halves joined at a hinge point, each of said first and second halves comprising a partially cylindrical portion with a radially extending flange at a top of said cylindrical portion.

37. A sash lock actuator according to claim 29, wherein said second end of said slider includes a pair of legs defining a slot for engaging said locking mechanism.

38. A sash lock actuator according to claim 29, wherein said second end of said slider comprises a single-point extension, said single-point extension having a pair of arms and a latch opening for receiving a single point latch of said locking mechanism.

39. A sash lock actuator according to claim 38, wherein each of said arms has a curved end surface for contacting said single point latch and directing said single point latch into said latch opening upon rotation of said handle.

40. A sash lock actuator according to claim 29, wherein said slider has at least one fulcrum tab extending from a top thereof, said fulcrum tab being positioned on said slider for contacting a side surface of said crank upon rotation of said handle.

41. A sash lock actuator according to claim 29, wherein said slider has first and second fulcrum tabs extending from a top thereof, said fulcrum tabs being positioned adjacent opposite sides of said slot, whereby upon rotation of said handle a side surface of said crank contacts one of said fulcrum tabs.

* * * * *